US006702330B2

(12) United States Patent
Roca

(10) Patent No.: US 6,702,330 B2
(45) Date of Patent: Mar. 9, 2004

(54) BOOK WITH HIDDEN SPINE

(76) Inventor: Robert John Roca, 3617 Hayden Ave., #200, Culver City, CA (US) 90232

( * ) Notice: Subject to any disclaimer, the term of this patent is extended or adjusted under 35 U.S.C. 154(b) by 0 days.

(21) Appl. No.: 10/172,985

(22) Filed: Jun. 18, 2002

(65) Prior Publication Data

US 2003/0230887 A1 Dec. 18, 2003

(51) Int. Cl.[7] ..... B42D 1/00

(52) U.S. Cl. ..... 281/21.1; 281/15.1; 281/36; 281/51

(58) Field of Search ..... 281/15.1, 19.1, 281/21.1, 29, 36, 51

(56) References Cited

U.S. PATENT DOCUMENTS

| | | | | |
|---|---|---|---|---|
| 2,082,423 A | | 6/1937 | Schade | |
| 2,142,816 A | | 1/1939 | Grumbacher | |
| 2,355,037 A | * | 8/1944 | Einzig | 281/46 |
| 4,128,262 A | * | 12/1978 | Du Corday | 281/34 |

* cited by examiner

*Primary Examiner*—Monica S. Carter

(57) ABSTRACT

The present invention relates to bindings for books, wherein the spine is hidden behind an extension of the cover. Specifically, a piping element is inserted into a recess formed by a doubled-over center section of a cover of the book. Because of the structure of the piping element, the book is capable of laying flat when opened, while hiding the spine and concurrently protecting both the spine and other objects from damage.

26 Claims, 9 Drawing Sheets

BOOK WITH HIDDEN SPINE

BACKGROUND OF THE INVENTION

1. Field of the Invention

The present invention relates to bindings for books. Specifically, by providing a stitched doubled-over center section to form a recess in a cover of the book, and a piping element placed in the recess, the spine of the book may be hidden from view.

2. Background

In conventional book bindings, using round or spiral binding elements, such as metal coils or rings, the binding elements are generally disposed such that they are visible from outside of the book. However, such an arrangement is often objectionable, for aesthetic and other reasons. For example, the binding elements may cause injury or damage to articles with which they may contact, as well as having the potential to become damaged themselves.

Prior attempts to hide the binding elements include U.S. Pat. No. 2,082,423 to Schade, herein incorporated by reference in its entirety. Therein, a coiled wire is hidden by a stitched cover requiring two lines of stitching to maintain the structure of the binding. However, due to the construction of this binding, the resulting product will tend to lean to one side when the book is opened. Thus, when the book is opened, the pages and coil will generate forces preventing the book from laying flat.

It would be desirable to provide a hidden spine for a book, which also permits the book to lie flat, despite forces acting on the spine laterally.

SUMMARY OF THE INVENTION

The present invention relates to hidden spine for books wherein a piping element is inserted into a recess formed by a doubled-over center section of the cover of the book. In particular the book having a hidden spine comprises a cover comprising a front section, a back section and a doubled-over center section, the front section and the back section being connected to or integral with the doubled-over center section; the doubled-over center section comprising a first section and a second section and having a longitudinal axis, the first section comprising a first top surface, a first outer longitudinal edge portion and a first inner longitudinal edge portion, the second section comprising a second top surface, a second outer longitudinal edge portion and a second inner longitudinal edge portion, the first top surface being opposed to the second top surface to form a flange section; a piping element having a longitudinal axis and extending longitudinally along the first and second outer longitudinal edge portions and comprising a stem and a transverse head, wherein at least a portion of the stem is located between the first and second top surfaces and the stem is integral with or attached to the head, the first and second top surfaces are attached to the piping element along an attachment portion of the stem at or adjacent the first and second outer longitudinal edge portions; and at least one page connecting element linked to at least one member of the group consisting of the piping element and the doubled-over center section. Optionally, the first inner longitudinal edge portion is integral with the second inner longitudinal edge portion.

Typically stitching, used to secure the pages to the book, is also used to maintain the piping element in position. In one embodiment, the piping element is in the general shape of a "T" and formed from a resilient structure. Due to the construction, the ends of the T-shape help to maintain the book in a closed position, in addition to ensuring that the book lie flat when opened.

In its method aspects the present invention relates to a method of forming a hidden spine for a book comprising: providing a cover, having a front section and a back section and providing a piping element comprising a stem and a crossbar; folding the cover about the piping element and bending the crossbar such that the cover is in a folded position and the piping is between the front section and the back section and the crossbar is bent away from the stem and a doubled-over center section of the cover is formed; stitching together the cover and the stem while the cover is in the folded position and the crossbar is bent; creating a plurality of holes in at least one member of the group consisting of the doubled-over center section and the stem; passing at least one page connecting element through the plurality of holes. Typically, the stitching penetrates through the stem.

DETAILED DESCRIPTION

Figure 1:
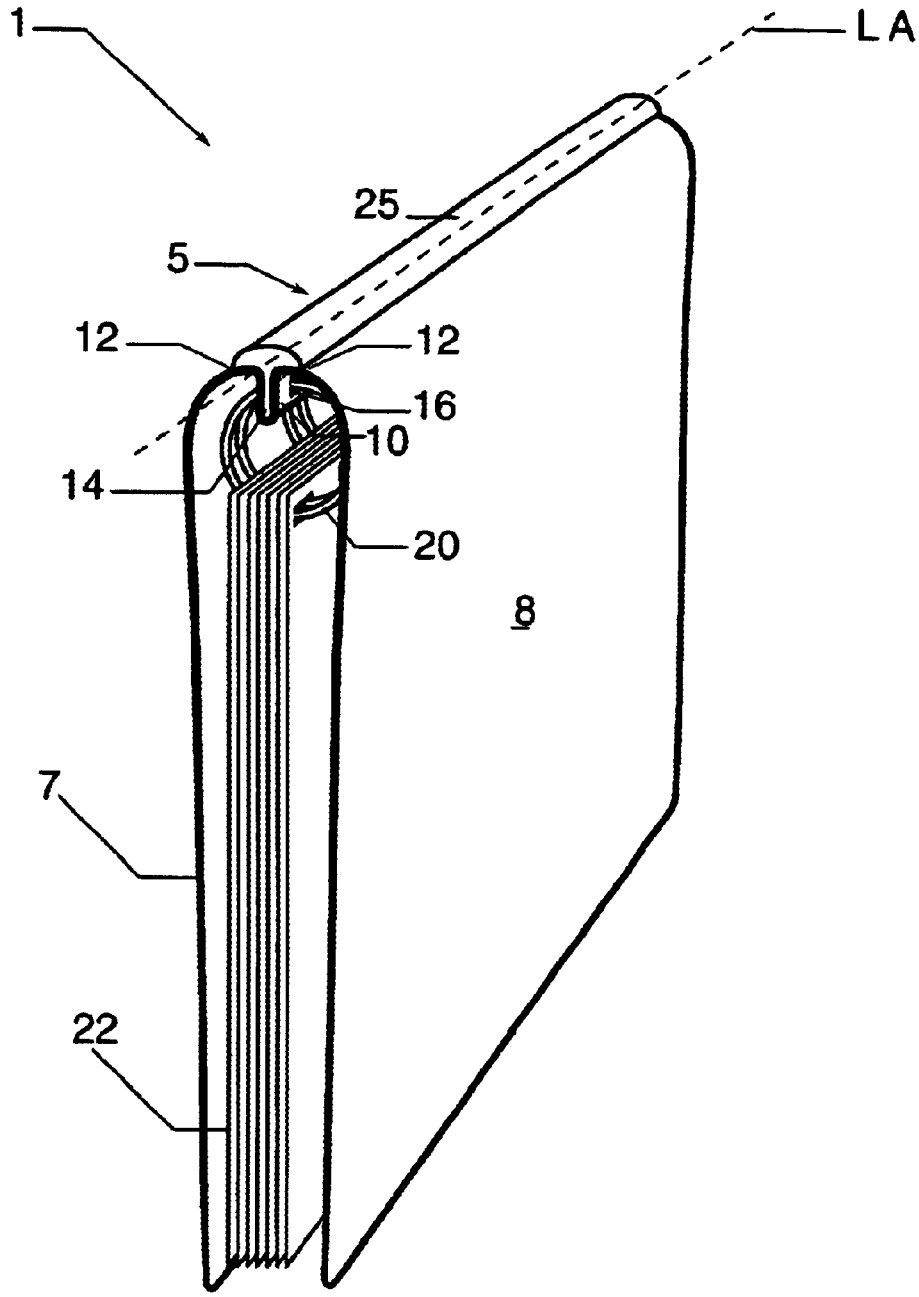
FIG. 1 is a plan view showing the structure of the hidden spine of a first embodiment of the invention.
Figure 2:
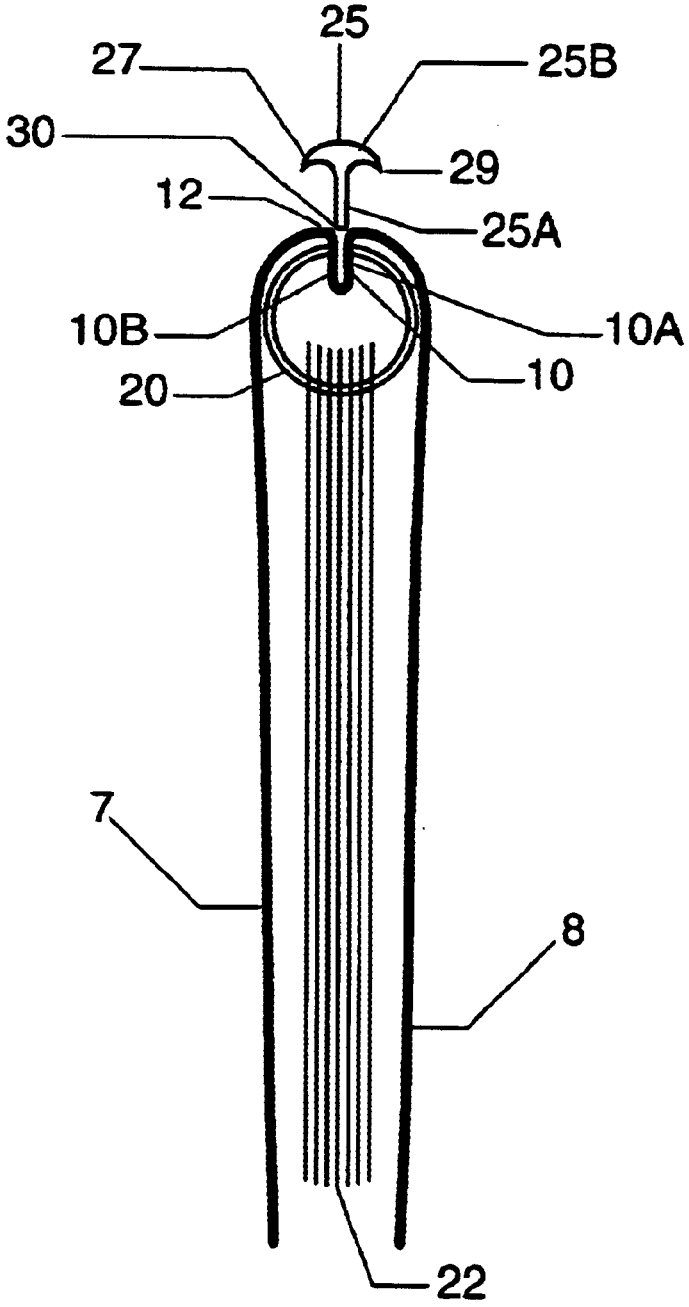
FIG. 2 is an end view of the hidden spine of the embodiment of FIG. 1 with the piping element removed.

With reference to FIG. 1, a book 1 is provided with a piping element 25. The piping element 25 is disposed between a front section 7 and a back section 8 of a book cover 3, in the vicinity of a doubled-over center section 10 (FIG. 2). Shoulders 12 are located where the front section 7 and back section 8 respectively meet the doubled-over center section 10. Front section 7 and back section 8 and center section 10 may be integrally formed, as in FIG. 1, or front section 7 and back section 8 may be attached to center section 10 at a crease such as a weld (not shown).

Figure 3:
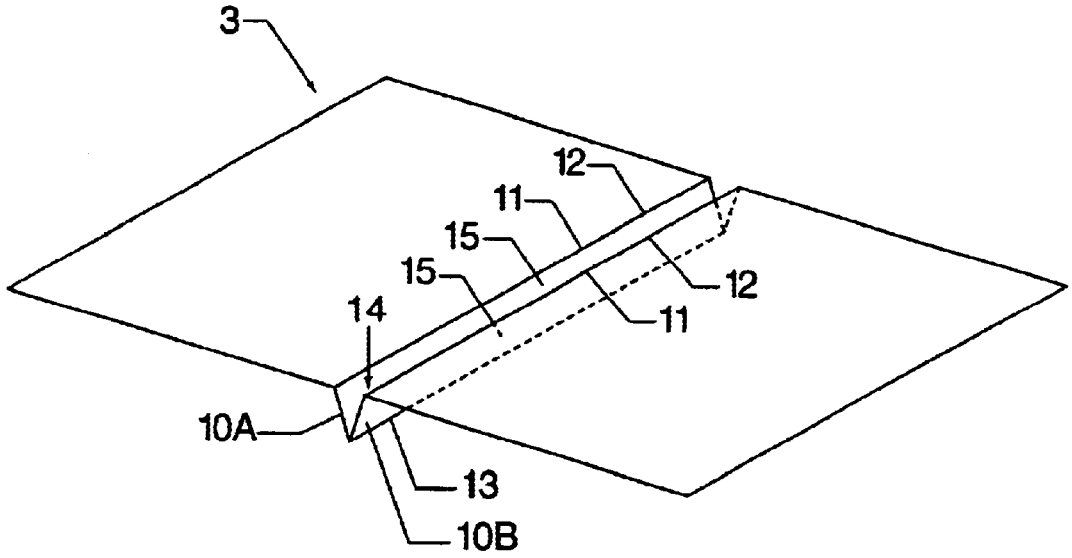
FIG. 3 is a view of a cover of the book alone of FIG. 1.

The doubled-over center section 10 and has two sections 10A, 10B (FIG. 3) to form a recess 14 (FIG. 3). Each section 10A, 10B has an outer longitudinal edge portion 11, an inner longitudinal edge portion 13 (shown as integral edges in FIG. 3), and a top surface 15. "Outer" and "inner" for the edges 11, 13, respectively, refer to their positions when the book 1 is in a closed position, as for example shown by FIG.

1. The expression "top" for the surface 15 relates to the position of the surface 15 as shown by FIG. 3 and merely functions as a label for the element.

Through doubled-over center section 10 a plurality of openings 16 (FIG. 4) are located. Page connecting elements 20 pass through the plurality of openings 16. Openings 16 may be pairs of aligned holes through the two parts 10A, 10B (FIG. 2) of doubled-over center section 10. Typically, the piping element 25 also has holes 16A aligned respectively with the holes 16. Pages 22 are attached to book 1 through page connecting elements 20. Thus, the piping element 25 and sections 10A, 10B reinforce each other to hold connection elements 20.

The piping element 25 has a "T" shape and comprises a stem 25A and a transverse head 25B. In use, the stem 25A of the piping element 25 is located within recess 14. Typically, the stem 25A has sufficient length and has holes 16A for the page connecting elements 20 to pass through it. Also, typically stitching 37 passes through sections 10A, 10B and through the stem 25A. Thus the stitching forms holes 16B (FIG. 4) in the stem 25A.

Figure 4:
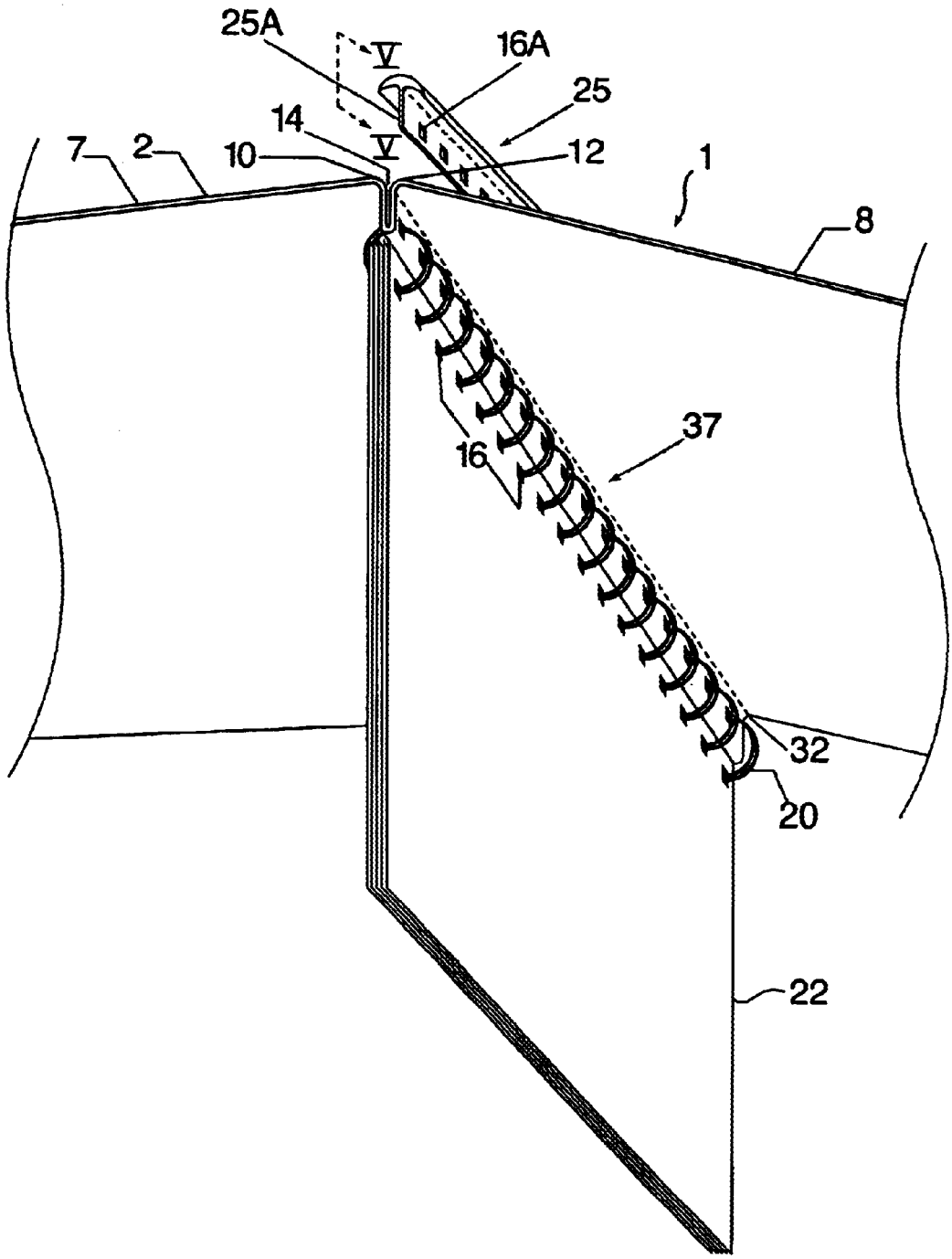
FIG. 4 is a plan view of the spine of the embodiment of FIG. 1 with the book in an open position and the piping element removed for clarity.
Figure 5:
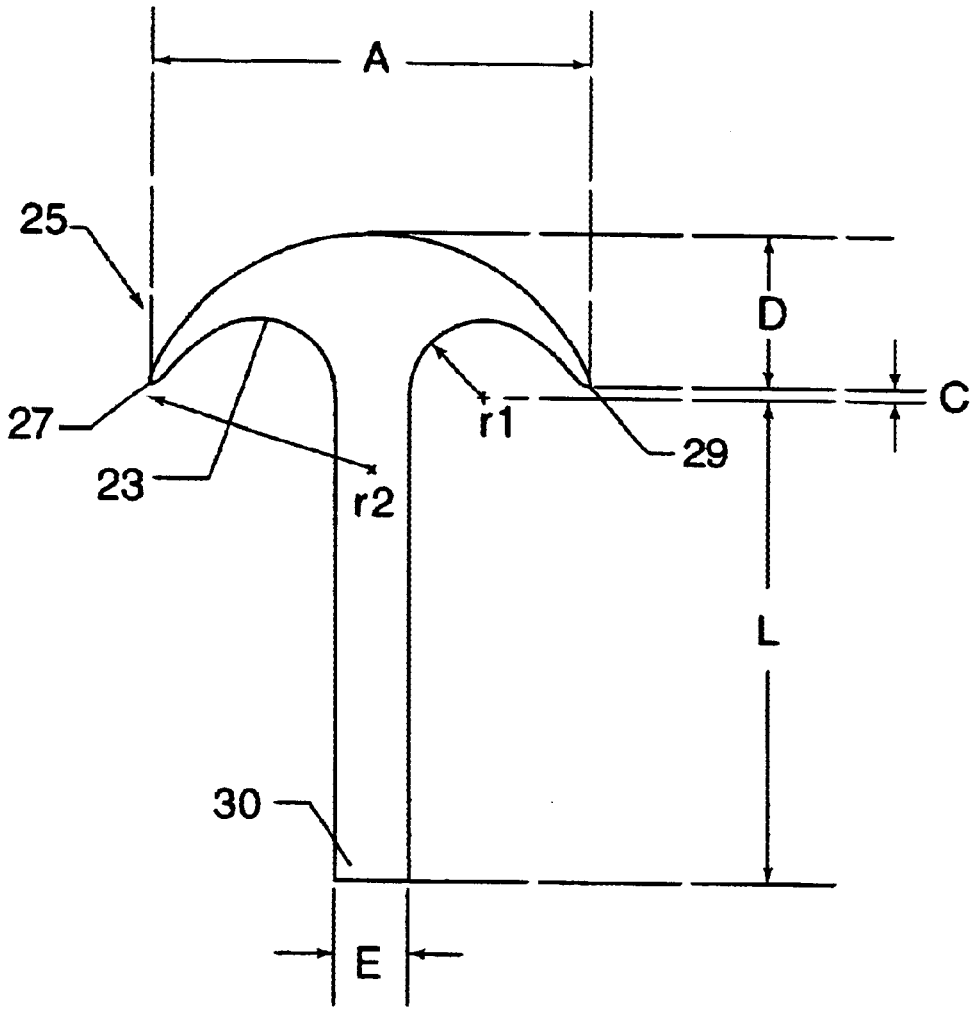
FIG. 5 is an enlarged view of an end view of section V—V of FIG. 4 of the piping element of FIG. 1 that shows typical dimensions and rounded opposed ends.

FIG. 5 shows an enlarged view of an end view of section V—V of FIG. 4 and shows typical dimensions of piping element 25. In FIG. 5 the dimensions are as follows width "A"=7/32 inch; height "L" equals 13/32 inch; height "C" equals 3/128 inch; height "D" equals 1/16 inch; width "E" equals 3/128 inch; radius of curvature $r_1$ equals 3/64 inch; and radius of curvature $r_2$ equals 9/64 inch. Typically these dimensions can be varied ±10% or ±30% or more depending, for example, upon the cover used with the piping element 25.

FIG. 2 shows book 1 in the closed position, i.e., back 8 and front 7 laying in different planes. With book 1 in such a position, the stem 25A of piping element 25 is located within recess 14, before the stitching 37 of FIG. 3 is put into place. In the embodiment shown in FIG. 2, piping element 25 has a general "T"-shape, and the transverse head 25B has two ends 27 and 29 and the stem 25A has an end 30. When fully constructed, stem 25A is inserted into recess 14, such that it is hidden from view. However, ends 27 and 29 rest adjacent to doubled-over center section 10 of the cover. Ends 27, 29 may be sharp as shown in FIG. 2 or rounded as shown in FIG. 5. The transverse head 25B of FIG. 5 may also be known as a crossbar. The colors of the piping element 25 and the cover 3 may be the same or different.

Figure 6:
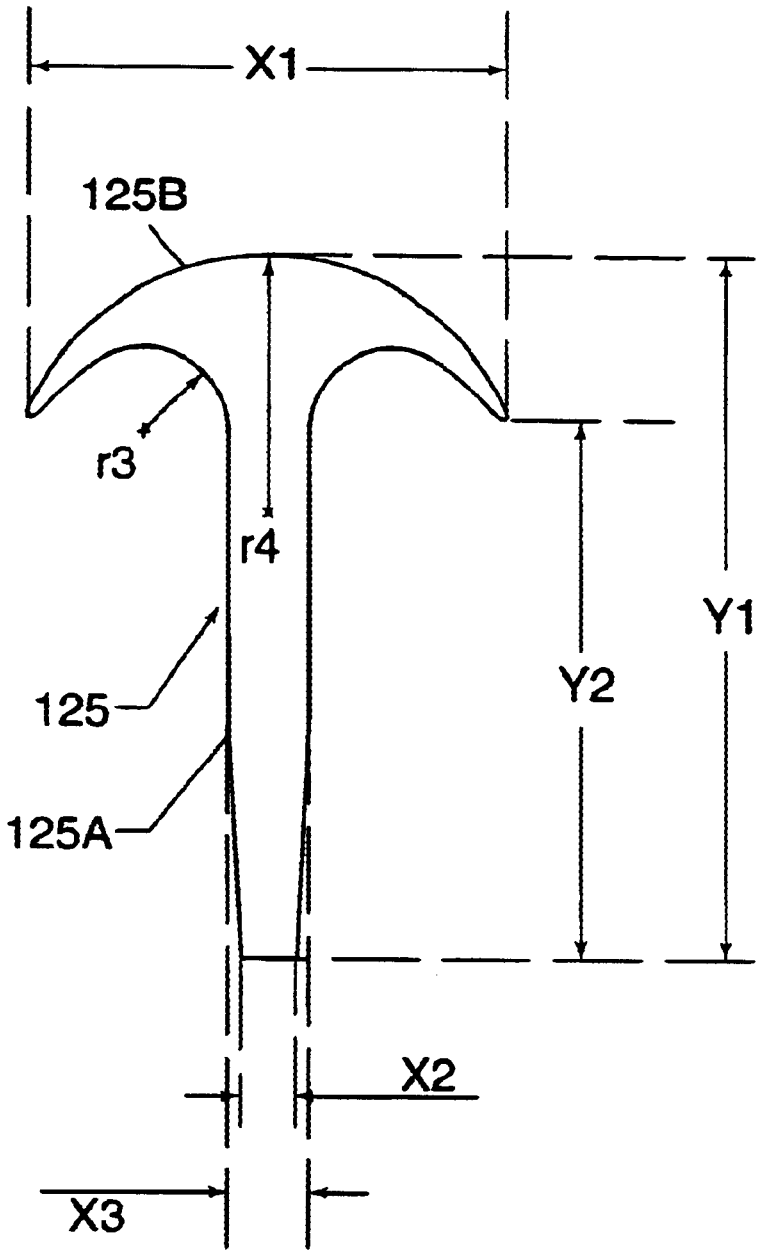
FIG. 6 is a side view of a second embodiment of the piping element having a tapered end.

In a second embodiment, a stem 125 has a tapered end 125A and a transverse head 125B as shown in FIG. 6. The tapered end 125A facilitates simultaneously stamping and die cutting holes 16, 16A into the parts 10A, 10B and stem 125. FIG. 4 shows typical dimensions of piping element 125. In FIG. 6 the dimensions are as follows width "X1"0.213 inches; width "X2" equals 0.020 inches; width "X3" equals 0.030 inches; height "Y1" equals 0.313 inches; height "Y2" equals 0.244 inches; radius of curvature $r^3$ equals 0.051 inches; and radius of curvature $r^4$ equals 0.116 inches. Typically these dimensions can be varied ±10% or ±30% or more depending, for example, upon the cover used with the piping element 125.

Figure 10:
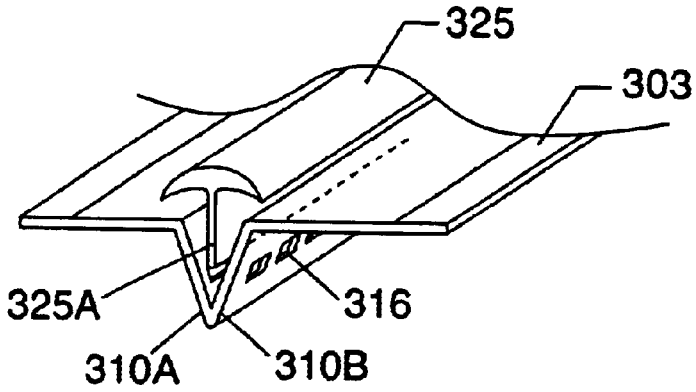
FIG. 10 shows an embodiment having a short piping element, relative to a center section of the cover of FIG. 3, and having aligned holes only through the cover.

Preferably, piping element 25, and in particular rounded ends 27 and 29 are formed from a material having memory. For example, piping element 25 may include a metal wire, or similar structure, which when ends 27 and 29 are diverted from their natural positions, the internal structure of piping element 25 permits maintaining book 1 either in either an open or closed position. Typically, the material is flexible enough that the ends 27, 29 can be bent back when the cover front 7 and back 8 are bent to have access to stitch the stem 25A to the cover 3 (FIG. 10). However, the material is resilient enough to exert pressure on the shoulders 12 to snugly press against the shoulders (FIG. 1). Typically, the stitching is sewn close to the transverse head 25B so that the cover shoulders 12 stay snug to the armpit undersides 23 (FIG. 5) of the transverse head 25B.

Typically the transverse head 25B of the piping element 25 has an upper convex outer surface 27A and concave underside surfaces 27B. Preferably, the radius of curvature r2 of the upper convex outer surface 27A is greater than the radius of curvature r1 of the concave underside surfaces 27B. This radius relationship encourages a snug fit to the undersides 23 to shoulders 12.

Typically the material of piping element 25 is a polymer. A typical PVC polymer has a durometer shore A hardness of 60 to 90 or 60 to 70. A typical polymer is virgin extruded polyvinyl chloride having the properties listed on Table 1.

TABLE 1

P.V.C. (Virgin) EXTRUSIONS
Physical Properties Compound

| | | ASTM |
|---|---|---|
| Specific Gravity (±0.2) | 1.32 | D-792 |
| Hardness - Shore A (±3) | 90 | D-2240 |
| Tensile Strength (pounds per square inch) | 2760 | D-4123 |
| Elongation Percent | 365 | D-412 |

1. Specific Gravity - relative density
2. Hardness - The durometer based on Shore A is a measure of flexibility and rigidity.
3. Tensile Strength - Pounds per square inch that the material will withstand before breaking.
4. Elongation - Determines how far the product will stretch before bursting.

ODOR - Inoffensive
TEAR STRENGTH - 250 DPI minimum
FADE-O-METER EXPOSURE - Minimum 200 standard FADE-O-METER hours
WEATHER-O-METER EXPOSURE - Minimum 200 standard WEATHER-O-METER hours
COLD TEST - A 1" × 6" × .080" strip of material shall be first aged 7 days at 80° C.–2° C. the 1 day at −40° C.–2° C. The strip shall be bent around a 2 inch diameter mandrel in not more than three seconds without any evidence of breaking, cracking, splitting, etc.

Other typical polymers include polyolefin, polyurethane, polystryrene, a polymer latex synthetic rubber, such as carboxylated styrene, butadiene copolymer, ethylene propylene diene monomer (EPDM) rubber, or other elastomer. For example, a carboxylated styrene/butadiene copolymer such as BAYPREN latex, available from Bayer, may be employed.

Figure 7:
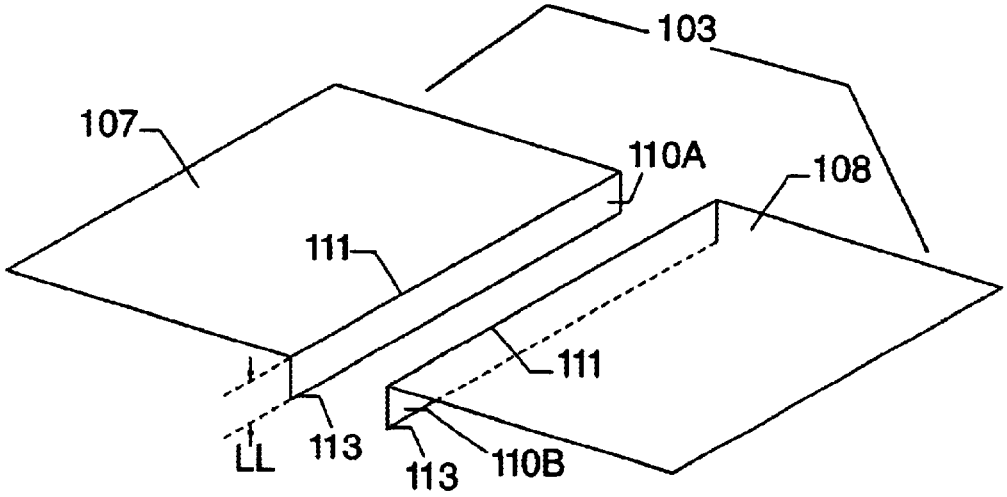
FIG. 7 shows a second embodiment of a cover of the present invention.

The cover 3 may also be made of a material suitably flexible to bend to facilitate construction, yet rugged enough to be a cover. This facilitates making the entire cover from a single sheet as explained below. However, if desired a cover 103 maybe made of two sheets 107, 108, as shown in FIG. 7. The two sheets have an inner longitudinal edge If desired, the construction and/or shape of piping element 25 may tend to generate a force to fully open front 7 and back 8 only when front 7 and back 8 are manually passed a particular open threshold apart, such as 30°, 45° or 75°. That is to say, unless front 7 and back 8, through doubled-over center section 10, are manipulated to define an angle greater than the predetermined open threshold, piping element 25 maintains book 1 closed. However, when front 7 and back 8, through doubled-over center section 10, are manipulated to define an angle greater than the predetermined open threshold, piping element 25 provides a force to assist in opening book 1 and to maintain book 1 in the open position. As such, a user need only separate front 7 and back 8 a small amount, after which, piping element 25 takes over and fully opens book 1.

FIG. 4 shows a particular embodiment of the invention partially assembled. In particular, piping element 25 has been removed in order to show the general construction of the invention. Although not required by the invention, FIG. 4 shows a plurality of page connecting elements 20 maintaining pages 22 in book 1. Each page connecting element 20 passes though one opening 16, i.e., pair of aligned holes, to hold page 22 inside book 1. After piping element 25 has been inserted into recess 14, stitching 32 is added, through doubled-over center section 10 to (1) secure doubled-over center section 10 closed and (2) prevent piping element 25 from exiting recess 14.

Figure 9:
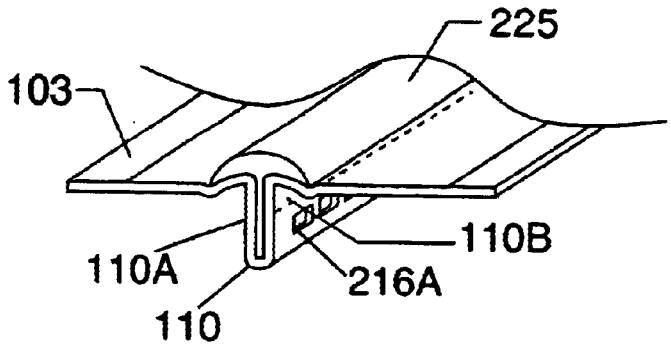
FIG. 9 shows an embodiment having aligned holes through both the cover of FIG. 7 and a piping element.
Figure 8:
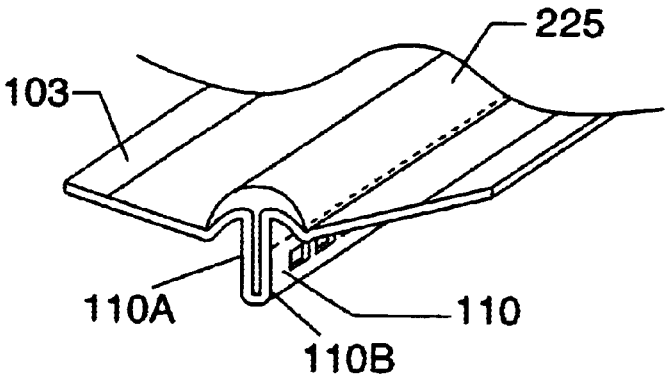
FIG. 8 shows an embodiment not having aligned holes through the cover of FIG. 7, but having holes through the piping element.
Figure 11:
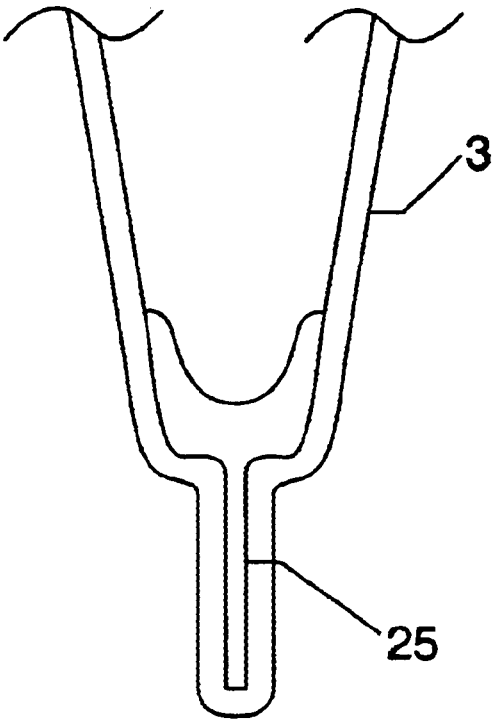
FIG. 11 shows the cover and piping element in a bent position.

If desired, the two part cover 103 of FIG. 7 may have sections 110A, 110B having a length "LL" which is longer or shorter than the length "L" of stem 125A of FIG. 6. For example, FIG. 8 shows the two part cover 103 employed with a piping element 225 having a stem 225A having a relatively longer length protruding from the inside edges 113 such that only the stem 225 need have holes 216A therethrough. In contrast, FIG. 9 shows the lengths as equal.

If desired, the one part cover 3 is employed with stem 125A, and sections 10A, 10B having a length "LL" which is longer or equal to the length of "L" of stem 125A. FIG. 9 shows length "LL" greater than length "L" of stem 325A of piping element 325 such that only parts 310A, 310B need have holes 316 therethrough. In contrast, FIG. 1 shows the lengths of sections 10A, 10B and stem 25A as equal.

Preferably, stitching 32 is positioned in a line, parallel to the longitudinal axis "LA" of piping element 25 and/or the longitudinal axis of center section 10 shown in FIG. 1. As such, stitching 32 can actually be located through the center section 10 at or adjacent the shoulder 12 (at or adjacent the joint between front 7 and/or back 8 and doubled-over center section 10). However, it is within the scope of the invention to position stitching 32 at any location along doubled-over center section 10 between the shoulder 12 and holes 16, 16A. Additionally, stitching 32 need not extend completely along doubled-over center section 10. Stitching 32 assists to hold doubled-over center section 10 closed and piping element 25 in position, and, when book 1 is manipulated into the open position (manually or automatically due to internal forces), stitching 32 keeps doubled-over center section closed and assists to keep book 1 flat against a surface when the book 1 is in an open position.

Stitching 32 may be replaced by another suitable fastener such as staples (not shown) or rivets (not shown).

Straight end 30 of piping element 25 is inserted into recess 14 before stitching 32 is added. Straight end 30 may also assist in maintaining the arrangement of book 1 when in the open position. For example, in one embodiment (not shown), straight end 30 may be provided with a structural element, such as a metal strip along its length, either internal to straight end 30 or fastened to its length, resisting bending of straight end 30. Therefore, when book 1 is opened, and pages 22 through page connecting elements 20 create a force tending to push and/or pull doubled-over center section 10 towards either front 7 or back 8, piping element 25 can resist such forces and keep page connecting elements 20 in place.

It must be understood that although page connecting elements 20 are shown in the Figs. as being closed circular wires, the invention is not so limited. For example, in another embodiment not shown, page connecting elements 20 are joined into a single structure, such as a spiral metal coil, passing through each opening 16, e.g., similar to a coil of a conventional spiral notebook. As long as page connecting elements 20 form a joint between pages 22 and at least one member of the group consisting of stem 25 and doubled-over center section 10, any shape is sufficient.

The hidden spine of the invention is preferably constructed in the following manner. A cover 3, having a front section 7 and a back section 8 and a piping element 25 comprising a stem 25A and a crossbar 25B, are provided. The cover 3 is folded about the piping element 25 and the crossbar 25B is bent such that the cover 3 is in a bent or folded position (FIG. 10) and the piping element 25 is between the front section 7 and the back section 8 and the crossbar 25B is bent away from the stem 25A and a doubled-over center section 10 of the cover 3 is formed. Then, the cover 3 and the stem 25A are stitched together while the cover 3 is in the folded position and the crossbar 25B is bent. Then a plurality of holes 16 and/or 16A are created in at least one member of the group consisting of the doubled-over center section and the stem 25A. At least one page connecting element 20, for example a metal wire spiral, is passed through the plurality of holes 16 and/or 16A. Typically, the stitching 37 penetrates through the stem 25A and sections 10A, 10B.

The holes 16 and/or 16A can be cut before or after the cover 3 and piping element undergo one or more of the steps of being contacted, bent and stitched together.

If the cover 103 (FIG. 7) is formed of two separate pieces 107, 108 stitched together during construction of the invention, then openings 116 may pass through doubled-over sections 110A, 110B of center section 110 and stem 125 (FIG. 9) or, in an alternative, openings 216A pass through only stem 225 (FIG. 8). The holes can be cut before or after the covers and piping elements of FIGS. 8 and 9 undergo one or more of the steps of being contacted, bent and stitched together.

The particular order of these steps is not mandatory. For example, it is possible to create doubled-over center section 10 after creating openings 16, 16A or pages 22 may be attached to page connecting elements 20 prior to being assembled into the structure of the invention.

It should be apparent that embodiments other than expressly described above come within the spirit and scope of the present invention. Thus, the present invention is not limited by the foregoing description but rather by the claims appended hereto.

I claim:

1. A book with a hidden spine comprising:

a cover comprising a front section, a back section and a doubled-over center section, the front section and the back section being connected to or integral with the doubled-over center section;

the doubled-over center section comprising a first section and a second section and having a longitudinal axis, the first section comprising a first top surface, a first outer longitudinal edge portion and a first inner longitudinal edge portion, the second section comprising a second top surface, a second outer longitudinal edge portion and a second inner longitudinal edge portion, the first top surface being opposed to the second top surface to form a flange section;

a piping element having a longitudinal axis and extending longitudinally along the first and second outer longitudinal edge portions and comprising a stem and a transverse head, wherein at least a portion of the stem is located between the first and second top surfaces and the stem is integral with or attached to the head, the transverse head extends from the stem transversely relative to the longitudinal axis of the piping element, the first top surface and second top surface are attached to the piping element along an attachment portion of the stem; and at least one page connecting element linked to at least one member of the group consisting of the piping element and the doubled-over center section;

optionally the first inner longitudinal edge portion is integral with the second inner longitudinal edge portion.

2. The book of claim 1, wherein the attachment portion, at which the first top surface and second top surface are attached to the piping element, is at or adjacent the first and second outer longitudinal edge portions, and the at least one page connecting element is linked to the at least one member of the group consisting of the piping element and the doubled-over center section at a location more distal to the transverse head than is the attachment portion.

3. The book of claim 2, wherein the page connecting element is linked to the piping element and the doubled-over center section.

4. The book of claim 2, wherein stitching attaches the first and second top surfaces to the piping element along the attachment portion of the stem at or adjacent the first and second outer longitudinal edge portions, and the attachment portion of the stem is close to the transverse head.

5. A book with a hidden spine comprising:

a cover comprising a front section, a back section and a doubled-over center section, the front section and the back section being connected to or integral with the doubled-over center section;

the doubled-over center section comprising a first section and a second section and having a longitudinal axis, the first section comprising a first top surface, a first outer longitudinal edge portion and a first inner longitudinal edge portion, the second section comprising a second top surface, a second outer longitudinal edge portion and a second inner longitudinal edge portion, the first top surface being opposed to the second top surface to form a flange section;

a piping element having a longitudinal axis and extending longitudinally along the first and second outer longitudinal edge portions and comprising a stem and a transverse head, wherein at least a portion of the stem is located between the first and second top surfaces and the stem is integral with or attached to the head, the transverse head extends transversely from the stem relative to the longitudinal axis of the piping element, the first top surface and second top surface are attached to the piping element along an attachment portion of the stem; and at least one page connecting element linked to at least one member of the group consisting of the piping element and the doubled-over center section; optionally the first inner longitudinal edge portion is integral with the second inner longitudinal edge portion;

wherein the piping element comprises a T-shape, wherein the head is a crossbar and the stem is perpendicularly connected to or integral with the crossbar at approximately the center of the crossbar.

6. The book of claim 5, wherein the crossbar has a convex outer surface and has two concave undersides on opposed sides of the stem, each underside of the crossbar has a radius of curvature, the outer surface of the crossbar has a radius of curvature, and respective opposed ends of each underside of the crossbar contact the cover.

7. The book of claim 6, wherein the piping element is made of a bendable resilient material having shape memory.

8. The book of claim 6, wherein the piping element is made of a bendable resilient polymer having shape memory.

9. The book of claim 5, wherein the crossbar has a convex outer surface and two concave undersides on opposed sides of the stem and a radius of curvature of each underside of the crossbar is smaller than a radius of curvature of the outer surface of the crossbar, and respective opposed ends of each underside of the crossbar contact the cover.

10. The book of claim 9, wherein a location where the front section meets the doubled-over center section forms a first shoulder and a location where the back section meets the doubled-over center section forms a second shoulder, wherein each respective concave underside of the crossbar contacts a respective said shoulder.

11. The book of claim 9, wherein the piping element is made of a bendable resilient material having shape memory and the crossbar contact the cover to exert pressure on the cover.

12. The book of claim 1, wherein the cover has a color different from a color of the piping element.

13. The book of claim 1, wherein the stem has an end distal to the head and the distal end is tapered.

14. The book of claim 1, wherein the at least one connecting element comprises a coil.

15. The book of claim 14, wherein the coil is metal.

16. The book of claim 14, wherein the doubled-over center section comprises at least one pair of aligned holes, though which the coil passes.

17. The book of claim 14, wherein the doubled-over center section comprises a plurality of pairs of aligned holes, and at least one of the circular elements passing though one of a plurality of pairs of aligned holes in the doubled-over center section.

18. The book of claim 14, wherein the doubled-over center section comprises a plurality of pairs of aligned holes, and at least one of the circular elements passes through one of a plurality of pairs of aligned holes in the doubled-over center section and passes through a hole of the stem.

19. A method of forming a hidden spine for a book comprising:

providing a cover, having a front section and a back section and providing a piping element comprising a stem and a crossbar, the crossbar extends transversely from the stem relative to a longitudinal axis of the piping element;

folding the cover about the piping element and bending the crossbar such that the cover is in a an inside-out folded position and the piping element is between the front section and the back section and the crossbar is bent away from the stem and a doubled-over center section of the cover is formed;

fastening together the cover and the stem while the cover is in the folded position and the crossbar is bent away from the stem;

creating a plurality of holes in at least one member of the group consisting of the doubled-over center section and the stem;

passing at least one page connecting element through at least one hole of the plurality of holes.

20. The method of claim 19, wherein the fastening comprises stitching which penetrates through the stem and the cover.

21. The method of claim 20, wherein the stitching attaches the doubled over center section to the piping element along an attachment portion of the stem, wherein the attachment portion of the stem is close to the transverse head.

22. The method of claim 21, wherein the piping element is made of a bendable resilient material having shape memory and the piping element comprises a T-shape in an original position, wherein the head is the crossbar and the stem is perpendicularly connected to or integral with the crossbar at approximately the center of the crossbar, wherein the crossbar is bent from the original position to the position wherein the cross-bar is bent away from the stem, and wherein after the stitching the crossbar returns to the original position.

23. The method of claim 22, wherein the crossbar has a convex outer surface and has two concave undersides on opposed sides of the stem, each underside of the crossbar has a radius of curvature, the outer surface of the crossbar has a radius of curvature, and respective opposed ends of each underside of the crossbar contact the cover.

24. The book of claim 7, wherein stitching attaches the first and second top surfaces to the piping element along the attachment portion of the stem at or adjacent the first and second outer longitudinal edge portions, and the attachment portion of the stem is close to the transverse head.

25. The book of claim 8, wherein stitching attaches the first and second top surfaces to the piping element along the attachment portion of the stem at or adjacent the first and second outer longitudinal edge portions, and the attachment portion of the stem is close to the transverse head.

26. The book of claim 4, wherein the piping element is made of a bendable resilient material having shape memory.

* * * * *